US011766094B2

(12) United States Patent
Weiss

(10) Patent No.: US 11,766,094 B2
(45) Date of Patent: Sep. 26, 2023

(54) FOOT DEVICE

(71) Applicant: WASHINGTON UNIVERSITY, St. Louis, MO (US)

(72) Inventor: Michael D. Weiss, University City, MO (US)

(73) Assignee: Washington University, St. Louis, MO (US)

( * ) Notice: Subject to any disclaimer, the term of this patent is extended or adjusted under 35 U.S.C. 154(b) by 105 days.

(21) Appl. No.: 17/319,176

(22) Filed: May 13, 2021

(65) Prior Publication Data

US 2021/0267311 A1 Sep. 2, 2021

Related U.S. Application Data

(63) Continuation of application No. 16/341,212, filed as application No. PCT/US2017/059476 on Nov. 1, 2017, now Pat. No. 11,033,075.

(Continued)

(51) Int. Cl.

*A43B 3/00* (2022.01)
*A43B 7/14* (2022.01)

(Continued)

(52) U.S. Cl.

CPC ..... *A43B 17/023* (2013.01); *A43B 3/0063* (2013.01); *A43B 7/1425* (2013.01); *A43B 7/1435* (2013.01); *A43B 17/14* (2013.01)

(58) Field of Classification Search

CPC ... A43B 3/0063; A43B 7/1425; A43B 7/1435; A43B 7/144; A43B 7/1485; A43B 7/149; A43B 7/24; A43B 17/023

See application file for complete search history.

(56) References Cited

U.S. PATENT DOCUMENTS 1,808,460 A * 6/1931 Gregarek ..... A43B 7/1425 36/147
1,808,461 A * 6/1931 Gregarek ..... A43B 7/22 36/43

(Continued)

FOREIGN PATENT DOCUMENTS

| | | | |
|---|---|---|---|
| EP | 1116449 | A2 | 7/2001 |
| EP | 1124461 | B1 | 8/2001 |
| WO | 2012174482 | A1 | 12/2012 |

OTHER PUBLICATIONS

International Search Report for International Application No. PCT/US2017/059476; dated Apr. 19, 2018; 1 page.

(Continued)

*Primary Examiner* — Sharon M Prange

(74) *Attorney, Agent, or Firm* — Armstrong Teasdale LLP

(57) ABSTRACT

Methods of using a foot device are disclosed herein. The foot device includes a generally U-shaped portion having an arcuate portion and first and second legs extending from the arcuate portion. Each leg has an end and a relief area disposed adjacent the respective end. A method of using the foot device comprises engaging the arcuate portion with a heel of a foot to form a first point of contact; positioning the relief area of the first leg proximate a fifth metatarsal head of the foot such that the fifth metatarsal head drops to form a second point of contact; and positioning the relief area of the second leg proximate a first metatarsal head of the foot such that the first metatarsal head drops to form a third point of contact, wherein the first, second, and third points of contact form a triangle-shaped contact surface.

13 Claims, 14 Drawing Sheets

Related U.S. Application Data

(60) Provisional application No. 62/415,600, filed on Nov. 1, 2016.

(51) Int. Cl.

| | |
|---|---|
| ***A43B 17/02*** | (2006.01) |
| ***A43B 17/14*** | (2006.01) |
| ***A43B 7/1425*** | (2022.01) |
| ***A43B 7/1435*** | (2022.01) |

(56) References Cited

U.S. PATENT DOCUMENTS

| | | | | | |
|---|---|---|---|---|---|
| 1,850,977 | A | * | 3/1932 | Musebeck | A43B 7/1435 36/43 |
| 1,992,081 | A | * | 2/1935 | Madinger | A43B 7/142 36/178 |
| 2,037,970 | A | | 4/1936 | Everston | |
| 2,089,384 | A | * | 8/1937 | Levitt | A43B 7/22 36/145 |
| 2,159,054 | A | * | 5/1939 | Silver | A43B 7/1435 36/145 |
| 2,255,100 | A | | 9/1941 | Brady et al. | |
| 2,411,901 | A | * | 12/1946 | Silver | A43B 7/1415 36/145 |
| 3,828,792 | A | | 8/1974 | Valenta | |
| 4,124,946 | A | * | 11/1978 | Tomlin | A43B 7/1435 36/43 |
| 4,360,027 | A | | 11/1982 | Friedlander et al. | |
| 4,494,321 | A | * | 1/1985 | Lawlor | A43B 13/20 D2/956 |
| 4,597,196 | A | | 7/1986 | Brown | |
| 4,759,136 | A | * | 7/1988 | Stewart | A43B 13/187 36/31 |
| 4,887,368 | A | | 12/1989 | Latzke | |
| 5,058,585 | A | | 10/1991 | Kendall et al. | |
| 5,170,572 | A | | 12/1992 | Kantro | |
| 5,174,052 | A | * | 12/1992 | Schoenhaus | A43B 7/144 36/176 |
| D383,894 | S | | 9/1997 | Snyder | |
| 6,070,342 | A | | 6/2000 | Brown | |
| D446,917 | S | | 8/2001 | Brown | |
| 6,269,554 | B1 | | 8/2001 | Silvestrini et al. | |
| D485,424 | S | | 1/2004 | Kielt et al. | |
| 6,732,456 | B2 | | 5/2004 | Hussain | |
| D497,472 | S | | 10/2004 | Vasyli | |
| 7,041,075 | B2 | | 5/2006 | Sullivan | |
| D599,994 | S | | 9/2009 | Elliott et al. | |
| D707,936 | S | | 7/2014 | Nash et al. | |
| 8,800,168 | B1 | * | 8/2014 | Propet | A43B 7/143 36/173 |
| D718,519 | S | | 12/2014 | Glazer | |
| 9,055,781 | B2 | * | 6/2015 | Tzeng | A61F 5/14 |
| 9,107,471 | B2 | | 8/2015 | Kitagawa | |
| 9,167,867 | B2 | | 10/2015 | Fahmi et al. | |
| 9,717,620 | B2 | | 8/2017 | Ban | |
| 10,506,843 | B2 | * | 12/2019 | Clough | A43B 7/1445 |
| 2010/0071231 | A1 | * | 3/2010 | Murphy | A43B 7/24 36/107 |
| 2011/0099842 | A1 | * | 5/2011 | Burke | A43B 7/1485 36/145 |
| 2011/0277348 | A1 | | 11/2011 | Fox et al. | |
| 2014/0007456 | A1 | | 1/2014 | Tadin | |
| 2016/0081837 | A1 | * | 3/2016 | Ban | A43B 7/1415 36/145 |
| 2016/0192732 | A1 | * | 7/2016 | Lenthe | A43B 17/003 36/43 |
| 2017/0224050 | A1 | * | 8/2017 | Schouwenburg | A43B 7/1485 |
| 2018/0249784 | A1 | * | 9/2018 | Lin | A43B 7/142 |

OTHER PUBLICATIONS

Written Opinion of International Application No. PCT/US2017/059476; dated Apr. 19, 2018; 4 pages.

* cited by examiner

FOOT DEVICE

CROSS REFERENCE TO RELATED APPLICATIONS

This application is a continuation of U.S. patent application Ser. No. 16/341,212, filed on Apr. 11, 2019, entitled FOOT DEVICE, which is the national stage entry of PCT/US2017/059476, filed on Nov. 1, 2017, entitled FOOT ENGAGEMENT DEVICE, which claims priority to and the benefit of U.S. Provisional Application No. 62/415,600, filed on Nov. 1, 2016, entitled SHOE INSERT, the entire contents of which are incorporated herein by reference.

BACKGROUND

The present disclosure relates generally to a foot engagement device, and more specifically, to a foot engagement device that improves balance and gait of a user by promoting proper foot mechanics. Specifically, the foot engagement device disclosed herein facilitates the foot achieving three points of contact in the form of a triangle.

Human feet carry the entire weight of the person and optimal foot function results when three distinct points of contact are achieved on each sole. Optimal foot function is based on a fundamental principle of physical science: the stability of a triangle. A triangular support structure optimizes balance overall and weight transfer during gait, thereby improving foot function while standing (static function) or walking (dynamic function).

The three points of contact in the form of a triangle are established by 1) the heel, 2) the fifth metatarsal head (outside ball of foot behind little toe), and 3) the first metatarsal head (inside ball of foot behind big toe). The fifth and first metatarsal heads possess tri-planar ranges of motion: there are three cardinal body planes (frontal, transverse, sagittal), and the first and fifth metatarsal heads are able to move in all three simultaneously. In comparison, the three center metatarsal heads (i.e., second, third, and fourth metatarsal heads) generally function in unison in up and down motions (sagittal plane only).

The fifth and first metatarsal heads are the second and third points of contact, respectively, in the triangle achieved during optimal foot function, and are important in both modes of foot function—static and dynamic. During standing (static function) the fifth and first metatarsal heads drop below the second, third and fourth metatarsal heads to form, along with the heel, a triangle-shaped contact surface. During walking (dynamic function), as weight begins to load the foot at initial heel strike, the forces start to transfer along the lateral portion of the foot towards the fifth metatarsal head. As the weight reaches the fifth metatarsal head, force shifts medially to the first metatarsal head for the push-off phase of gait. When weight transfer is smooth, three points of contact are maintained throughout the process, achieving a "moving triangle" effect and a symmetrical gait pattern.

Factors that interfere with achieving three points of contact in each foot include non-symmetrical limb lengths, poor muscle tone, the effects of aging, and the surface beneath the individual, among others. A lack of proper balance can have dire consequences, especially for the elderly. Recent studies concluded that improper weight transfer caused 41% of falls by the elderly and 95% of hip fractures in the elderly resulted from side-to-side falls. Additionally, falls are the most common cause of traumatic brain injuries.

Optimal foot function is typically easier to achieve on soft surfaces, which allow the structures of the foot to move independently of each other and achieve three points of contact. Shoes and hard surfaces inhibit flexibility in the foot, making the three points of contact more difficult to achieve. On hard flat surfaces, the fifth and first metatarsal heads are limited in their ability to drop below the plane shared by the second, third, and fourth metatarsal heads. If these two outside metatarsal heads cannot establish independent points of contact apart from the three center metatarsal heads, the ability of the foot to achieve a triangular support structure is significantly compromised.

The impact of foot function, whether standing or walking, cascades upward through the body, impacting the ankles, knees, hips, lower back, upper back, shoulders, and the positioning of the head. From an anatomical perspective when standing or walking, the body works to achieve a stable and balanced head position (i.e., the body wants to keep the head straight). When balance and/or body symmetry are out of alignment, the joints, muscles, and ligaments in the feet, legs, hips, back, and shoulders often work against each other to achieve the objective of a stable and balanced head position. This often results in discomfort and/or injury to the body parts under the excessive strain.

Thus, there is a need for a foot engagement device (e.g., a shoe insert, shoe insole) that facilitates achieving three points of contact for the human foot on both hard and soft surfaces when functioning both statically and dynamically—the three points being 1) the heel, 2) the fifth metatarsal head, and 3) the first metatarsal head. Additionally, there is a need for a foot engagement device that is able to center the heel in an article of footwear being worn. Moreover, there is a need for a foot engagement device that allows the fifth and first metatarsal heads to drop below the plane shared by the second, third, and fourth metatarsal heads during dynamic function of the foot.

BRIEF DESCRIPTION

In one aspect, a foot engagement device generally comprises a generally U-shaped portion. The U-shaped portion has an inner edge, an outer wall, and a tapered upper surface extending from the inner edge to the outer wall. The upper surface tapers between 1 degree and 45 degrees from the inner edge to the outer wall.

In another aspect, a foot engagement device has a heel portion, a middle portion, and a front portion. The foot engagement device comprises a generally U-shaped portion and a base portion. The U-shaped portion has an inner edge, an outer wall, a tapered upper surface extending from the inner edge to the outer wall, an arcuate portion and two legs extending from the arcuate portion. One of the legs has a length greater than the length of the other leg. The U-shaped portion is disposed in overlying face-to-face relationship with the base portion.

In yet another aspect, a foot engagement device defines a longitudinal axis X, a transverse axis Y, an insert axis I, and a metatarsal axis M. The insert axis I defines the main axis of the foot engagement device and is angularly offset from the longitudinal axis X. The metatarsal axis M defines an axis upon which the user's metatarsals are to be generally aligned and angularly offset from the insert axis I. The foot engagement device generally comprises a U-shaped portion having an arcuate portion, a first leg and a second leg. The first leg extends from the arcuate portion to a first end, and the second leg extends from the arcuate portion to a second end. The first end of the first leg and the second end of the second end are generally located along the metatarsal axis.

In still another aspect, a foot engagement device for engaging a foot of a user generally comprises a heel portion adapted to receive a user's heel including the calcaneus of the user and a middle portion adapted to receive a central part of the foot including the metatarsals of the user. U-shaped portion includes an arcuate portion, a first leg, and a second leg. The arcuate portion is disposed in the heel portion. The first and second legs extend outward from the arcuate portion to a respective end. The ends of the first and second legs are disposed in the middle portion. The second leg is longer than the first leg in order to accommodate for the anatomical longitudinal offset between a first metatarsal and a fifth metatarsal of the user's foot.

DETAILED DESCRIPTION OF THE DRAWINGS

In the following specification and the claims, reference will be made to a number of terms, which shall be defined to have the following meanings. The singular forms "a," "an," and "the" include plural references unless the context clearly dictates otherwise. The terms "comprising," "including," and "having" are intended to be inclusive and mean that there may be additional elements other than the listed elements. "Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. Here and throughout the specification and claims, range limitations may be combined and/or interchanged; such ranges are identified and include all the sub-ranges contained therein unless context or language indicates otherwise.

As used herein, positional terms such as upward, downward, upper, lower, top, bottom, and the like are used only for convenience to indicate relative positional relationships.

As used herein, the term "shoe insert" generally refers to any article adapted to be placed within or on an article of footwear between a lower surface of a user's foot (i.e., a sole of a user's foot) and the article of footwear (e.g., an insole of the footwear). In one suitable embodiment, the foot engagement device disclosed herein is in the form of a shoe insert. It is understood, however, that in other suitable embodiments, the foot engagement device disclosed herein is suitable for use other than as shoe inserts including, but not limited to, instances where the foot engagement device comprises a portion of the shoe itself (e.g., formed as a single-piece with the insole of the footwear), a stand-alone foot support, integrated into a sock, and the like without departing from some aspects of the present disclosure. It should be noted that as used herein, the term "footwear" means any suitable article intended to be worn on the foot.

Figure 1:
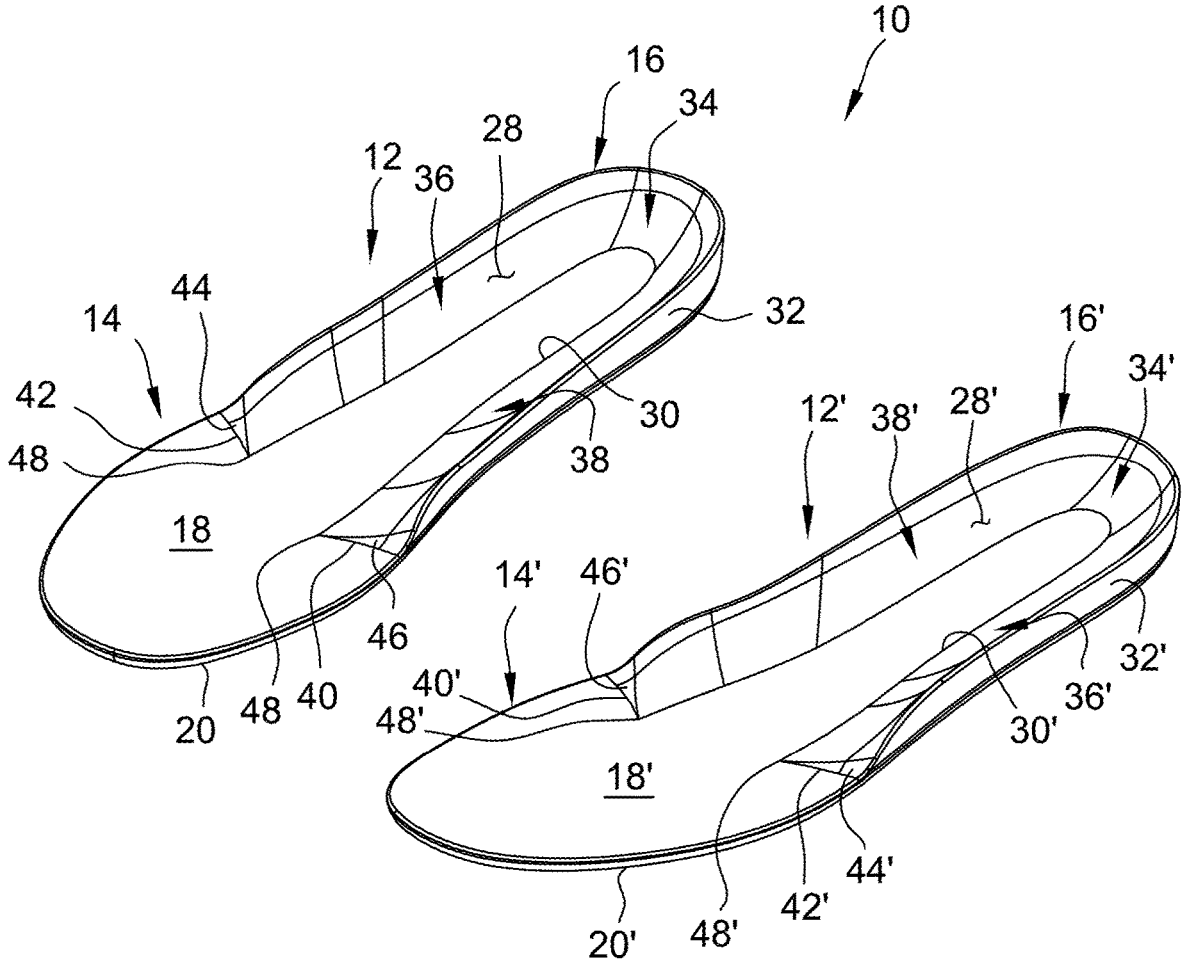
FIG. 1 is a perspective view of one suitable embodiment of a pair of foot engagement devices of the present disclosure in the form of a pair of shoe inserts, a left shoe insert (viewed to the right in FIG. 1) of the pair of shoe inserts is a mirror image of a right shoe insert (viewed to the left in FIG. 1).
Figure 2:
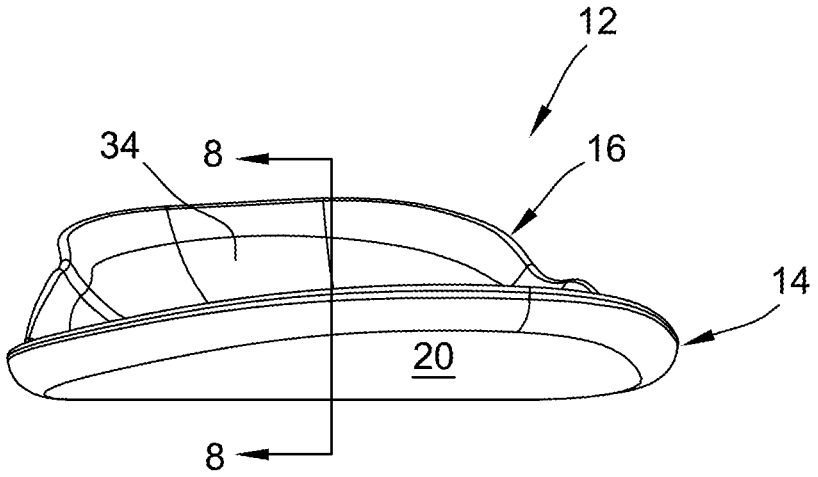
FIG. 2 is a front view of the right shoe insert of FIG. 1.
Figure 3:
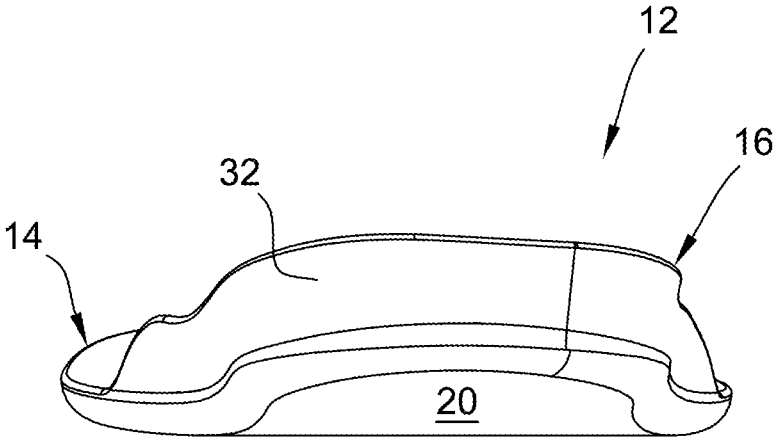
FIG. 3 is a rear view of the right shoe insert of FIG. 1.

Referring now to the drawings and in particular to the FIG. 1, one suitable embodiment of a pair of foot engagement devices of the present disclosure in the form of a pair of shoe inserts is indicated generally by reference numeral 10. A right shoe insert (viewed to the left in FIG. 1) of the pair of shoe inserts 10 is indicated generally at 12. A left shoe insert (viewed to the right in FIG. 1) of the pair of shoes inserts 10 is indicated generally at 12'. As seen in FIG. 1, the left shoe insert 12' is a mirror image of the right shoe insert 12. As a result, the reference numerals used to identify features of the left shoe insert 12' are the same as the reference numerals used to identify features of the right shoe insert 12 but include a "'". In addition, since the left shoe insert 12' is indeed a mirror image of the right shoe insert 12, only the right shoe insert of the pair of shoes inserts 10 is described in detail herein with the understanding that the left shoe insert 12' has the same features as the described right shoe insert.

With reference still to FIG. 1, both the right shoe insert 12 and the left shoe insert 12' illustrated therein includes a base portion, indicated at 14, 14', with a generally U-shaped portion, indicated at 16, 16', circumscribing a portion of the base portion. The right shoe insert 12 is sized and shaped to receive the user's right foot and, more specifically, for placement of a sole of the user's right foot against the right foot insert such that the user's sole is in face-to-face engagement with the right shoe insert, as described in more detail below. Likewise, the left shoe insert 12' is sized and shaped to receive the user's left foot and, more specifically, for placement of a sole of the user's left foot against the left foot insert such that user's sole is in face-to-face engagement with the left shoe insert. Thus, the right shoe insert 12 is configured for engagement with a right human foot, and the left shoe insert 12' is configured for engagement a left human foot.

The right and left shoe inserts 12, 12' can be formed from any suitable material including, but not limited to, thermoplastics, polypropylene, high-density polyethylene, acrylic, composite carbon fibers, cork, leather, and/or any material that enables the right and left shoe inserts to function as described herein. Suitably, the right and left shoe inserts 12, 12' are formed from the same material but it is contemplated that the right shoe insert can be formed from a material different than the left shoe insert.

A size and shape of the right and left shoe inserts 12, 12' can be predetermined based on industry standards, e.g., conventional sizing and/or shaping of footwear. Thus, the right and left shoe inserts 12, 12' can be manufactured to fit any size of footwear. In another suitable embodiment, the right and left shoe inserts 12, 12' can be customized to a specific user's feet. That is, the right and left shoe inserts 12, 12' disclosed herein can be made specifically for a particular user's feet without departing from some aspects of this invention.

In addition, the right and left shoe inserts 12, 12' can be formed from a single component or assembled from a number of components. In the illustrated embodiment, for example, the right and left shoe inserts 12, 12' are formed (e.g., molded) as a single component from a single material. It is contemplated that the right and left shoe inserts 12, 12' can be formed from more than a single material (i.e., two or more materials) and/or formed from more than one component and assembled together. For example, in one suitable embodiment, the base portion 14, 14' of the right and left shoe inserts 12, 12' can be formed separately from the respective U-shaped portion 16, 16'. In such an embodiment, the base portions 14, 14' can be formed from the same or different materials than the U-shaped portions 16, 16'. The base portions 14, 14' and the U-shaped portions 16, 16' can then be assembled together using any suitable method (e.g., adhesive bonding). Alternatively, the base portions 14, 14' and the U-shaped portions 16, 16' can be used as discrete components. That is, the base portions 14, 14' can be free of positive attachment (e.g., bonding) with the U-shaped portions 16, 16' without departing from some aspects of this disclosure. In such an embodiment, the U-shaped portion 16, 16' can be placed in overlying relationship with the respective base portion 14, 14' during use.

Figure 6:
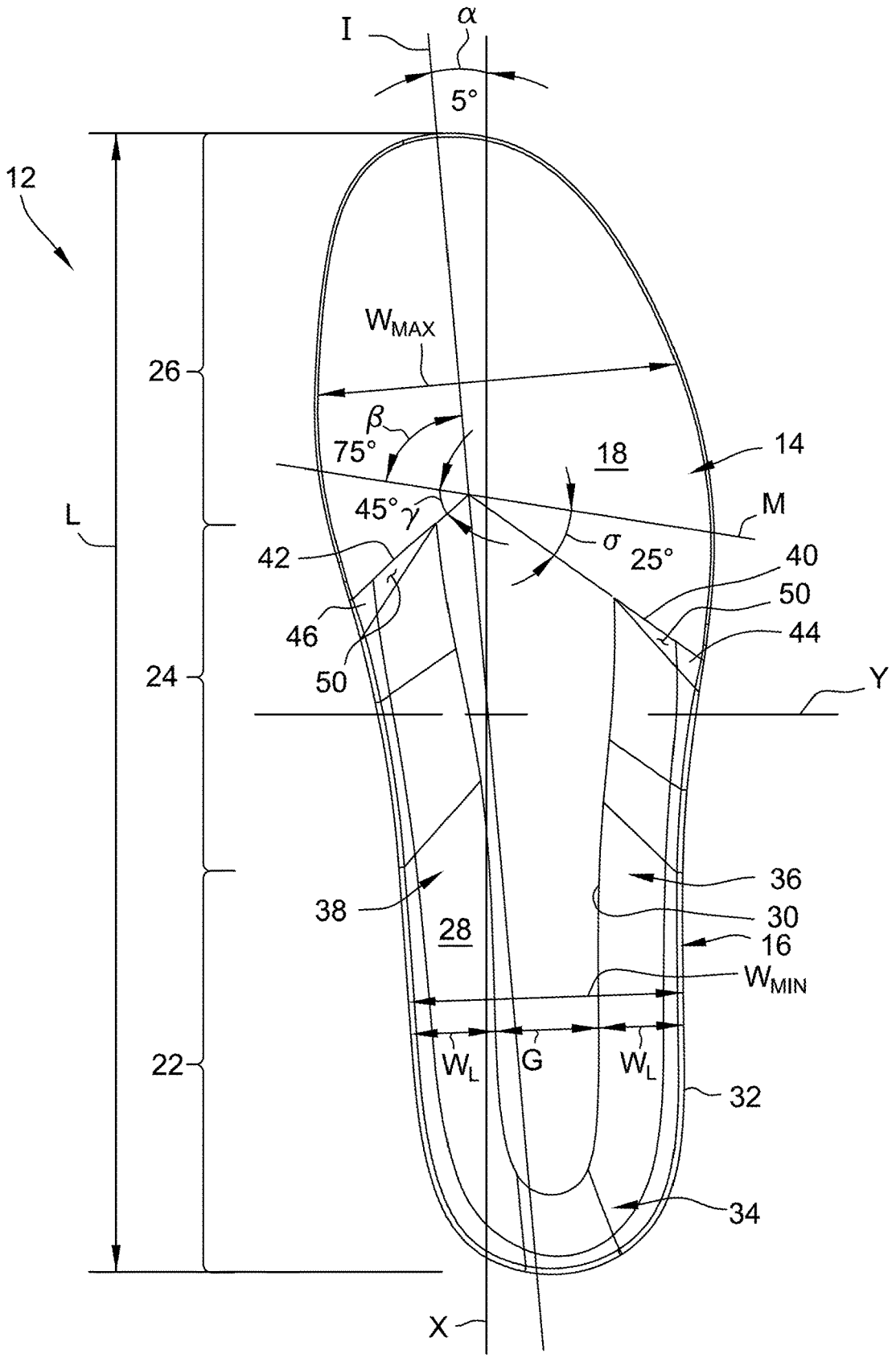
FIG. 6 is a top view of the right shoe insert of FIG. 1.

With reference generally to FIGS. 2-6, and specifically to FIG. 6, the right shoe insert 12 defines a longitudinal axis X, a transverse axis Y, and an insert axis I. The insert axis I defines the main axis of the right shoe insert 12 and is angularly offset from the longitudinal axis X. As a result, the insert axis I defines an angle a with the longitudinal axis X. In the illustrated embodiment, for example, the angle a between the insert axis I and the longitudinal axis X is approximately 5 degrees. It is contemplated that the angle a between the insert axis I and the longitudinal axis X can be any suitable value.

The right shoe insert 12 also defines an insert length L, a maximum width Wmax, which corresponds to the greatest extent in the transverse direction, and a minimum width Wmin, which corresponds to the least extent in the transverse direction. The length L is defined herein as the longitudinal distance between longitudinally outermost extents of the insert along the longitudinal axis X. The length L, Wmax, and Wmin can be any suitable values. In one suitable embodiment, the length L, Wmax, and Wmin are predetermined based on industry standards, e.g., conventional sizing of footwear. In another suitable embodiment, the length L, Wmax, and Wmin of the right shoe insert 12 can be customized to a specific user's foot. Generally, however, the overall size and shape of the right shoe insert 12 will depend on the size and shape of the footwear intended to be used with the insert.

Figure 7:
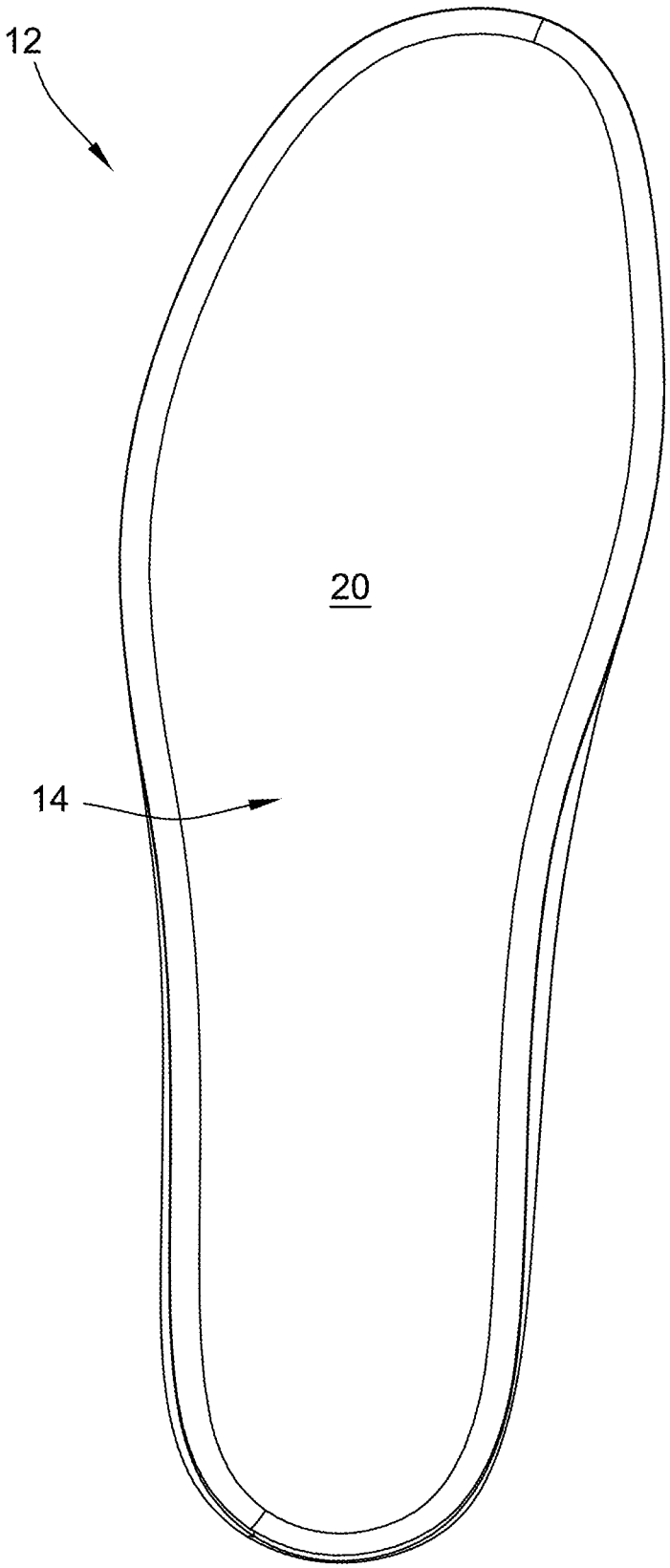
FIG. 7 is a bottom view of the right shoe insert of FIG. 1.
Figure 8:
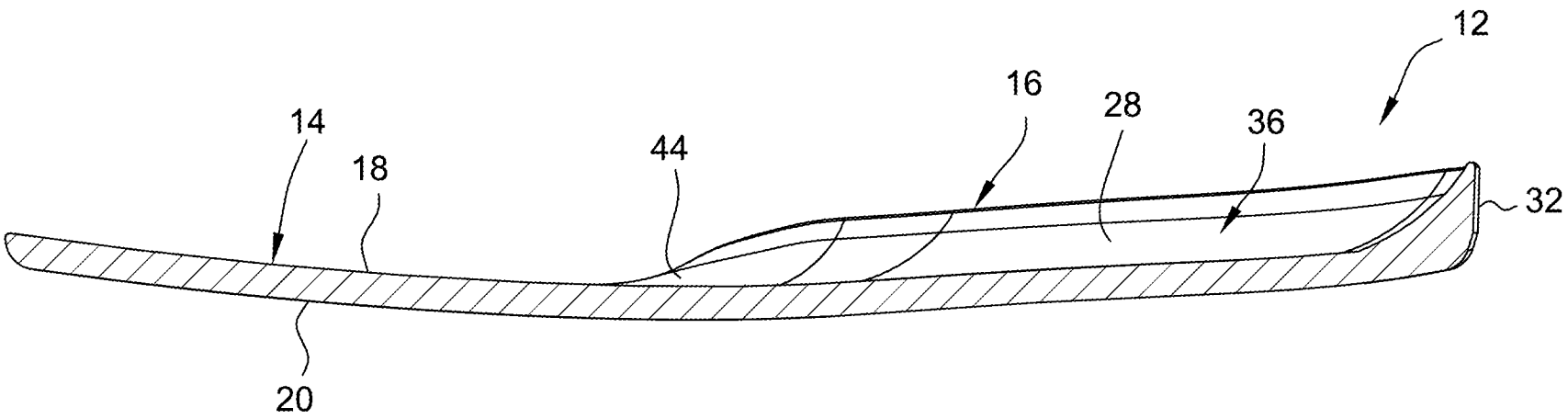
FIG. 8 is a cross-sectional view of the right shoe insert taken along line 8-8 of FIG. 2.

The right shoe insert 12 has a first side 18, which defines a foot-facing surface (FIG. 6), and a second side 20, which defines a shoe-facing surface (FIG. 7). The right shoe insert 12, as depicted in FIG. 6, can be suitably divided into three general longitudinal regions: a heel portion 22, a middle portion 24, and a front portion 26. Each of these portions 22, 24, 26, are sized and shaped to engage different regions of the user's foot. More specifically, the heel portion 22 is adapted to receive the heel (or rear part of the foot) including the calcaneus (or heel bone) of the user; the middle portion 24 is adapted to receive the central part of the foot including the metatarsals; and the front portion 26 is adapted to receive the forward part of the foot including the phalanges. In the illustrated embodiment, the heel portion 22, the middle portion 24, and the front portion 26 of the right shoe insert 12 have the same length (longitudinally extent). It is contemplated, however, that the heel portion 22, the middle portion 24, and the front portion 26 can have any suitable length including different lengths without departing from some aspects of this disclosure.

As seen in FIG. 6, the U-shaped portion 16 of the right shoe insert 12 illustrated therein generally extends longitudinally about two thirds the length L of the right shoe insert. In the illustrated embodiment, the U-shaped portion 16 extends through the heel portion 22 and into the middle portion 24 where it terminates. Thus, the front portion 26 of the illustrated embodiment of the right shoe insert 12 is free of the U-shaped portion 16. It is contemplated that the U-shaped portion 16 can have any suitable longitudinal extent that allows the right shoe insert 12 to function as disclosed herein. Thus, it is contemplated that forward parts of the U-shaped portion 16 can extend into the front portion 26 of the right shoe insert 12 without departing from some aspects of this disclosure.

Figure 4:
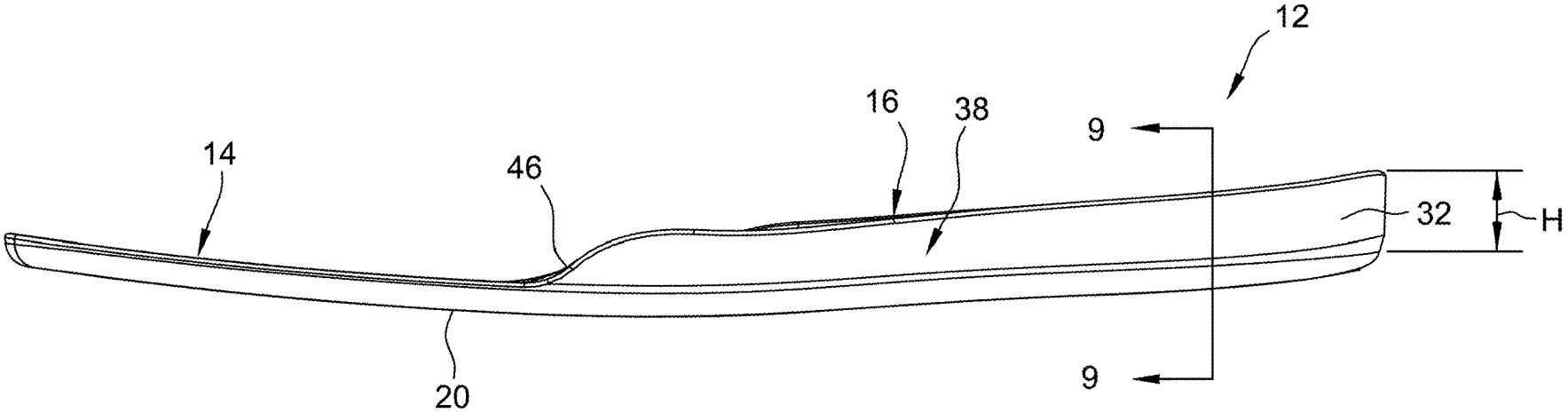
FIG. 4 is a left side view of the right shoe insert of FIG. 1.
Figure 5:
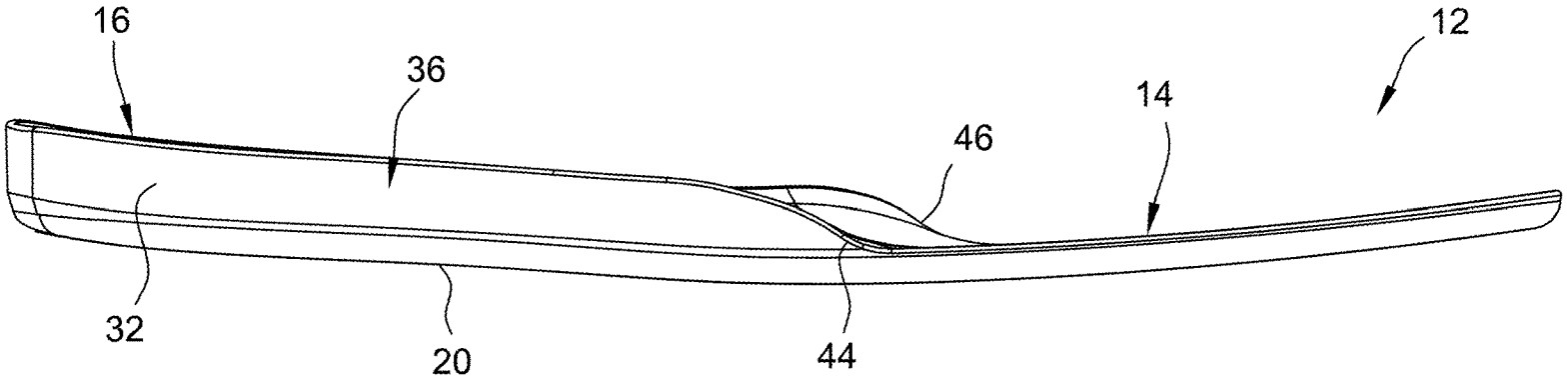
FIG. 5 is a right side view of the right shoe insert of FIG. 1.
Figure 9:
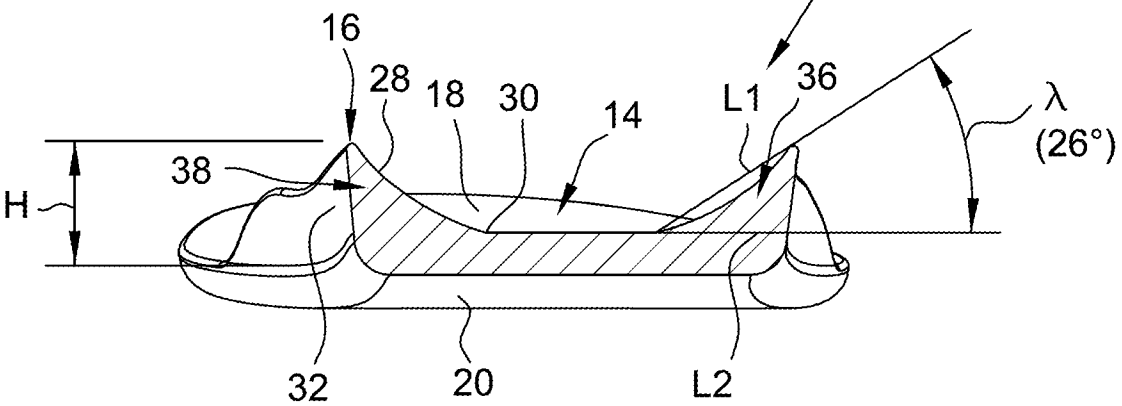
FIG. 9 is a cross-sectional view of the right shoe insert taken along line 9-9 of FIG. 4.

The U-shaped portion 16 includes an inwardly tapering upper surface 28, an inner edge 30 that defines the inner extent of the U-shaped body, and an outer wall 32 that defines the outer perimeter (or part) of the U-shaped body. The inner edge 30 defines the intersection between the inwardly tapering upper surface 28 and the base portion 14. The outer wall 32 is configured for contiguous relationship with an outer perimeter of the base portion 14. Thus, an outer perimeter of the U-shaped portion and an outer perimeter of the base portion 14 are aligned and coterminous. As illustrated in FIGS. 4 and 9, the outer wall 32 and thus, the U-shaped portion defines a height H. The height H is the greatest extent in which the U-shaped portion rises above the base portion 14.

With reference again to FIG. 6, U-shaped portion 16 of the right shoe insert 12 further includes an arcuate (or curved) portion, indicated at 34, a first leg, indicated at 36, and a second leg, indicated at 38. As seen in FIG. 6, the first leg 36 and the second leg 38 extend from the arcuate portion 34 of the U-shaped portion 16 to their respective ends 40, 42. As illustrated in FIG. 6, the first and second legs 36, 38 of the illustrated embodiment have substantially the same width WL in the heel portion 22. Moreover, the first and second legs 36, 38 run generally parallel each other through the heel portion 22 as they extend from the arcuate portion 34. The first and second legs 36, 38 then diverge away from each other as they extent through the middle portion 24 to their respective ends 40, 42. As a result, the distance between the first and second legs 36, 38 is greater in the middle portion 24 compared to the distance between the first and second legs 36, 38 in the heel portion 22.

In one suitable embodiment, the width WL of each of the first and second legs 36, 38 is approximately ⅓ the minimum width Wmin of the right shoe insert 12. Thus, the first leg 36 of the U-shaped portion 16 is approximately ⅓ the minimum width Wmin of the right shoe insert 12; the second leg 38 of the U-shaped portion 16 is approximately ⅓ the minimum width Wmin; and a gap G between the inner edge 30 of U-shaped portion 16 defining the first leg 36 and the inner edge of U-shaped portion defining the second leg 38 is approximately ⅓ the minimum width Wmin. Thus, the ratio between the width WL of the first leg 36, the width of the second leg 38, and the gap G can be expressed as 1:1:1. It is contemplated that the ratio between the width WL of the first leg 36, the width of the second leg 38, and the gap G can be any suitable ratio. Accordingly, it is contemplated that the first and second legs 36, 38 can have any suitable widths and that the widths between the first and second legs can also be different without departing from some aspects of this disclosure. That is, in some suitable embodiments, the first leg 36 can have a different width WL than the second leg 38.

In one suitable embodiment and with reference still to FIG. 6, the first and second legs 36, 38 can have different lengths. For example, in the embodiment illustrated in FIG. 6, the second leg 38 is longer than the first leg 36 to accommodate the length of the overlying anatomical feature of the foot that is desired to be influenced by the right shoe insert 12. More specifically, the second leg 38 is suitably longer than the first leg 36 in order to accommodate for the anatomical longitudinal offset between the first metatarsal and the fifth metatarsal of the human foot. Generally, the user's metatarsal heads, including the first metatarsal head and the fifth metatarsal head, align along a metatarsal axis M, which is illustrated in FIG. 6, during use. Moreover, the metatarsal axis M is intended to be generally aligned with (e.g., coaxial with) a break in the footwear, when the user is using the right shoe insert 12 with footwear having a break. The metatarsal axis M and the insert axis I cooperatively define an angle β, which is about 75 degrees in the illustrated embodiment.

In the illustrated embodiment, the ends 40, 42 of the first and second legs 36, 38 are angled back from the inner edge 30 of the U-shaped portion 16 toward the outer wall 32. In one suitable embodiment and as seen in FIG. 6, the end 40 of the first leg 36 is angled back approximately 25 degrees relative to the metatarsal axis M about an angle σ, and the end 42 of the second leg 38 is angled back approximately 45 degrees relative to the metatarsal axis M about an angle γ. It is understood that angles σ and γ can be any suitable angle besides 25 degrees and 45 degrees as disclosed wherein without departing from some aspects of this invention. Thus, the ends 40, 42 of the first and second legs 36, 38 can be angled back from the inner edge 30 of the U-shaped portion 16 to the outer wall 32 at any suitable angle. It is further contemplated that the ends 40, 42 of the first leg 36 and/or the second leg 38 can be generally straight as they extend from the inner edge 30 of the U-shaped portion to the outer wall 32.

With reference to now to FIGS. 6 and 9, the upper surface 28 of the U-shaped portion 16 of the illustrated embodiment is concave as it extends between the inner edge 30 and the outer wall 32. Moreover, the taper of the upper surface 28 defines an angle λ at least in a portion of the heel portion 22 of the right shoe insert 12 defined by 1) a line L1 extending the width of the upper surface that intersects the inner edge 30 and the outer wall 32, and 3) a planar line L2 that defines the lower extent of the U-shaped portion 16. In one suitable embodiment, the angle λ is between approximately 1 degree and 45 degrees. In the illustrated embodiment, for example, the angle λ is approximately 26 degrees. In other embodiment, for example, the angle λ is approximately 27 or 28 degrees. It is contemplated that the upper surface 28 can be other than concave (e.g., planar) without departing from some aspects of this disclosure. Suitably, however, the upper surface 28 of the U-shaped portion is not convex.

In the illustrated embodiment, the upper surface 28 of the U-shaped portion 16 has a uniform, continuous taper that is the same throughout the arcuate portion 34 and portions of each of the first and second legs 36, 38 within the heel portion 22 of the right shoe insert 12. It is contemplated, however, that the arcuate portion 34 can have a taper that differs from the taper of the legs 36, 38. In other suitable embodiments, the upper surface 28 of the arcuate portion 34, the first leg 36, and the second leg 38 can each have different angles. It is contemplated that the upper surface 28 of the U-shaped portion can have any suitable uniform or varying taper.

Within the middle portion 24 of the right shoe insert 12, the first leg 36 includes a first relief area 44 adjacent its end 40, and the second leg 38 includes a second relief area 46. The first relief area 44 is located on the right shoe insert 12 to generally correspond to the user's fifth metatarsal head. The fifth metatarsal head is located roughly at the outside ball of foot behind the little toe. More specifically, the first relief area 44 will be located rearward of the fifth metatarsal head of the user's right foot during use. The second relief area 46 is located on the right shoe insert 12 to generally correspond to the first metatarsal head. The first metatarsal head is located roughly at the inside ball of the foot behind the big toe. More specifically, the second relief area 46 will be rearward of the first metatarsal head of the user's right foot during use.

As seen in FIGS. 1 and 6, the first relief area 44 of the first leg 36 and the second relief area 46 of the second leg 38 are generally triangular shaped portions disposed adjacent the respective ends 40, 42. In fact, the first and second relief area 44, 46 define the ends 40, 42 of the first and second legs 36, 38. As a result, the forward-most extent of the first and second relief areas 44, 46 are angled back from the inner edge 30 of the U-shaped portion 16 to the outer wall 32 as described above with respect to the ends 40, 42. Thus, the part of the first and second relief area 44, 46 at the inner edge 30 are more forward on the right shoe insert 12 than the part of the first and second relief area at the outer wall 32.

As illustrated in FIGS. 1 and 6, both the first relief area 44 of the first leg 36 and the second relief area 46 of the second leg 38 are generally illustrated as a point 48 (or relatively small area) at or near the intersection of the inner edge 30 of the U-shaped portion 16 and the respect end 40, 42. A width of each of the first and second relief areas 44, 46 increases (i.e., the relief areas get wider) moving from the point 48 at the inner edge 30 toward the outer wall 32 to thereby define the generally triangular shape of each area. With reference still to FIGS. 1 and 6, a face (or surface) 50 of each of the first and second relief areas 44, 46 slopes forward from its intersection with the upper surface 28 of the U-shaped portion 16.

In one suitable embodiment, the right shoe insert 12, including the middle portion 24, is free of any arch support. In other words, the right shoe insert 12 (and more broadly the foot engagement device) disclosed herein does not include any structure specifically configured to support the user's arch. It is contemplated, however, that some embodiments of the present disclose may include an arch support without departing from some aspects thereof.

With reference now to FIG. 7, a bottom surface 20 of the right shoe insert 12 is illustrated therein. In this embodiment, the bottom surface 20 is adapted for face-to-face engagement with an insole of any suitable footwear. It is contemplated that the bottom surface 20 can include engagement enhancements, such as, friction enhancers or adhesive, to increase the engagement between the right shoe insert 12 and the underlying insole.

The foot engagement devices disclosed herein, including the right and left shoe inserts 12, 12' illustrated in FIG. 1, facilitate a user achieving three points of contact—1) the heel, 2) the fifth metatarsal head, and 3) the first metatarsal head—in the form of a triangle with each foot. Additionally, the foot engagement devices disclosed herein center and capture the heel of the user in footwear being worn by the user. Moreover, the foot engagement devices disclosed herein allow the fifth metatarsal head and the first metatarsal head to drop below the plane shared by the second, third, and fourth metatarsal heads during dynamic function of the foot. As a result, the foot engagement devices disclosed herein, include the right and left shoe inserts 12, 12' illustrated in FIG. 1, is believed to improve user balance and achieve a symmetrical gait pattern of the user by promoting proper foot mechanics.

In use, the user places their right foot into face-to-face engagement with the right foot insert 12, and/or the user places their left foot into face-to-face engagement with the left foot insert 12'. The right and left foot inserts 12, 12' are illustrated in FIG. 1. As mentioned above, the left foot insert 12' is a mirror image of the right foot insert 12 and includes the same features. Thus, the left foot insert 12' functions the same as the right foot insert 12. As a result, the function of only the right foot insert 12 will be described in detail with the understanding that the left foot insert 12' functions in the same manner.

Specifically, the user places their right foot into face-to-face engagement with the first, foot-facing surface 18 of the right foot insert 12 such that user's sole overlies and is in contact (directly or indirectly, e.g., a sock maybe disposed between the user's sole and the right foot insert) with the base portion 14 and the U-shaped portion 16. With a properly sized right shoe insert 12, the user's foot will be alignment with the heel portion 22, the middle portion 24, and front portion 26 of the right shoe insert. More specifically, the user's heel including the calcaneus of the user will be aligned with the heel portion 22; the central part of the foot including metatarsals will be aligned with the middle portion 24; and the forward part of the foot including the phalanges will be aligned with the front portion 26.

In the heel portion 22, the U-shaped portion 16 is sized and shaped to center and capture the user's heel. Specifically, the tapering upper surface 28 is sized and shaped (as discussed above) to capture the periphery of the user's heel. That is, the concaved, tapering upper surface 28 of the U-shaped portion engages, directs inward, and captures the periphery of the user's heel thereby centering the heel relative to the heel portion 22 of the right shoe insert 12 and any associate footwear. Thus, the periphery of the user's heel engages in face-to-face relationship the upper surface 28 of the U-shaped 16 portion in the heel portion 22 including the arcuate portion 34 and portions of the first and second legs 36, 38. Additionally, the user's heel engages base portion 14 in the gap G defined between the first and second legs 36, 38 of the U-shaped portion (i.e. the inner edges 30 of the U-shaped portion defined by the first and second legs 36, 38). Suitably, the outer wall 32 of the U-shaped portion 16 is in contact with the associated footwear during use thereby providing transverse stability to the U-shaped portion 16 to resist the forces exerted thereon by the user's heel.

In the middle portion 24 of the right shoe insert 12, both the base portion 14 and the U-shaped portion 16 continue to underlie the user's foot. More specifically, the periphery (or outer regions) of the user's central part of the foot overlie portions of the first leg 36 and second legs 36, 38 of the U-shaped portion 16, including the respective relief areas 44, 46 and ends 40, 42. The base portion 14 underlies the part of the user's foot disposed between and forward the first and second legs 36, 38 of the U-shaped portion. Suitably, the user's first metatarsal will be forward the relief area 46 disposed on the second leg 38, and the user's fifth metatarsal will be forward the relief area 44 disposed on the first leg 36 of the U-shaped portion 16. During standing (static function), the respective relief areas 44, 46 of the first and second legs 36, 38 allow and facilitate the fifth and first metatarsal heads dropping below the second, third and fourth metatarsal heads to form, along with the heel, a triangle-shaped contact surface. Preferably, the relief areas 44, 46 and the respective end 40, 42 of the first and second legs 36, 38 are located and configured to facilitate proper function of the user's first and fifth metatarsal as described in more detail below.

In use, the forward part of the user's foot including the phalanges overlies and is in contact with only the base portion 14 of the right shoe insert 12 in the front portion 26. As mentioned above, the front portion 26 of the right shoe insert 12 comprises only the base portion 14. Thus, the forward part of the user's foot is free from contact with the U-shaped portion 16.

The above generally describes the static function and interaction between the right human foot and the right shoe insert 12. As previously mentioned, the left human foot would have the same static function and interaction with the left shoe insert 12' as the right shoe insert 12. With respect now to the dynamic function of the right human foot and the right shoe insert 12. Again, the dynamic function of the left human foot and the left shoe insert 12' is the same as the right and, as a result, will not be described in detail.

As a user walks, the user's heel is the first part of the foot within the triangle defined by the heel, the fifth metatarsal head, and the first metatarsal head to make contact (albeit indirectly through, e.g., the footwear, right shoe insert 12, sock) with the surface upon which the user is walking. The user's heel including the calcaneus of the user, which is captured by the part of the U-shaped portion 16 within the heel portion 22 of the right shoe insert 12 as described above, is maintained in proper alignment. That is, the part of the U-shaped portion 16 with in the heel portion 22 (i.e., the arcuate portion 34 and parts of the first and second legs 36, 38) inhibits the user's heel from shifting (e.g., transverse movement) out of alignment. Accordingly, the user's heel is secured by the right shoe insert 12 and maintained in proper alignment during gait.

The next part of the user's foot in the triangle to make contact with the surface during optimal gait is the fifth metatarsal, which is forward the first relief area 44 disposed on the first leg 36 of the U-shaped portion 16. The third and final part of the user's foot in the triangle to make contact with surface during optimal foot function is the first metatarsal, which is forward the second relief area 46 disposed on the second leg 38 of the U-shaped portion 16. The fifth and first metatarsal heads possess tri-planar ranges of motion and are able to move in the three cardinal body planes (frontal, transverse, sagittal). The middle portion 24 of the right shoe insert 12 is adapted to allow the fifth and first metatarsal heads to move in all three planes.

While walking (or dynamic function of the foot), weight of the user begins to load the foot at initial heel strike, the load is transferred along the outer lateral portion of the foot towards the fifth metatarsal head. As the weight (or load) reaches the fifth metatarsal head, force shifts medially to the first metatarsal head for the push-off phase, which is the final phase of gait. When weight (or load) transfer is smooth, as facilitated by the right shoe insert 12, the three points of contact are maintained throughout the process, achieving a "moving triangle" effect and a symmetrical gait pattern.

The cornerstone of optimal foot function is a symmetrical gait pattern, which has a positive, holistic impact on the support structure of the body, which extends upward from the feet to the legs, back, shoulders and neck. The foot engagement devised disclosed herein facilitate achieving such optimal foot function.

Figure 10:
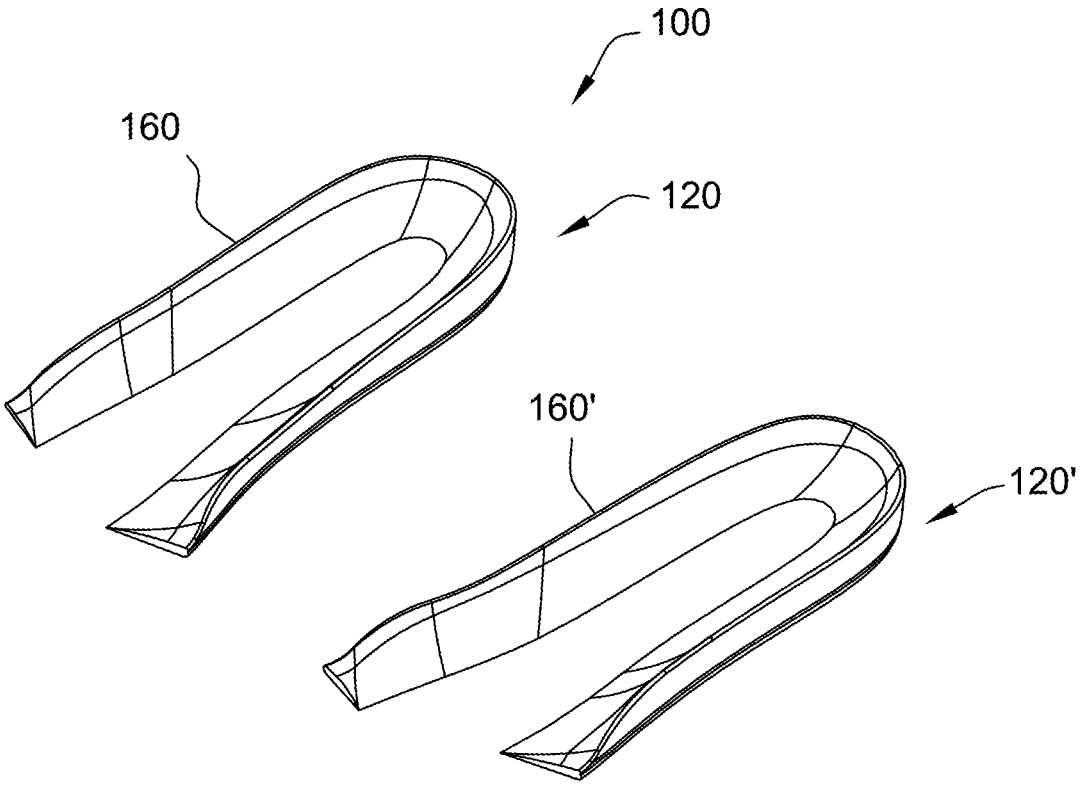
FIG. 10 is a perspective view of another suitable embodiment of a pair of foot engagement devices of the present disclosure in the form of a pair of shoe inserts, a left shoe insert (viewed to the right in FIG. 10) of the pair of shoe inserts is a mirror image of a right shoe insert (viewed to the left in FIG. 10).

FIG. 10 illustrates another suitable embodiment of a pair of foot engagement devices of the present disclosure in the form of a pair of shoe inserts is indicated generally by reference numeral 100. A right shoe insert (viewed to the left in FIG. 10) of the pair of shoe inserts 100 is indicated generally at 120. A left shoe insert (viewed to the right in FIG. 10) of the pair of shoes inserts 10 is indicated generally at 120'. As seen in FIG. 10, the left shoe insert 120' is a mirror image of the right shoe insert 120. As a result, the reference numerals used to identify features of the left shoe insert 120' are the same as the reference numerals used to identify features of the right shoe insert 120 but include a "'". The right shoe insert 120 and the left shoe insert 120' seen in FIG. 10 are substantially the same as the right shoe insert 12 and the left shoe insert 12', respectively, illustrated in FIG. 1 except that base portions 14, 14' are omitted. Thus, the right shoe insert 120 and the left shoe insert 120' seen in FIG. 10 include a generally U-shaped portion 160, 160' that is substantially the same as the U-shaped portion 16, 16' of FIG. 1.

Referring now to the drawings and in particular to the FIGS. 12-16, another suitable embodiment of a foot engagement device of the present disclosure in the form a shoe insert is indicated generally by reference numeral 200. In this embodiment, the shoe insert 200 is foot neutral in that it can be used with either the right foot or the left foot. While only one shoe insert 200 is illustrated in FIGS. 12-16, it is contemplated that the shoe insert 200 can be provided to a user individually or as a pair (i.e, one for both feet).

Figure 11:
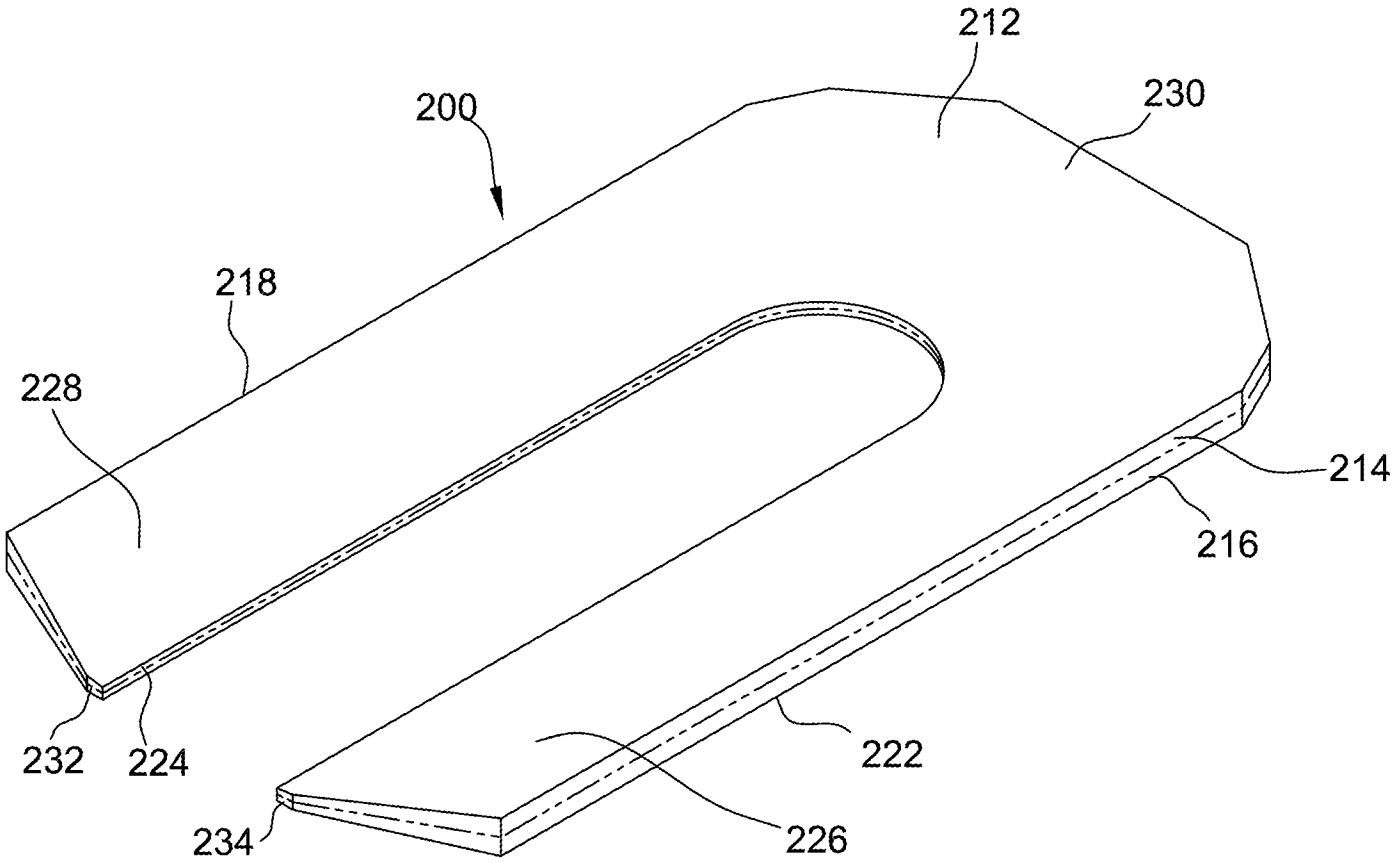
FIG. 11 is a perspective of another suitable embodiment of a shoe insert of the present disclosure, the shoe insert comprising a generally U-shaped portion having an upper surface, a lower surface, an inner edge, and an outer edge, with the upper surface tapering downward at an angle from the outer edge to the inner edge.
Figure 12:
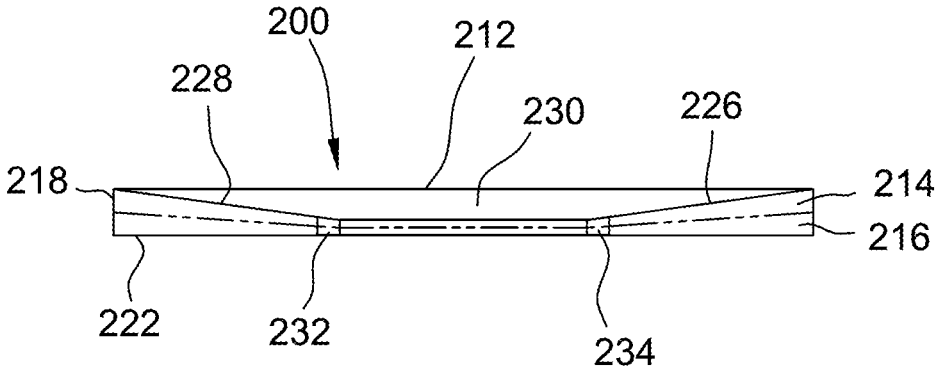
FIG. 12 is a front view of the shoe insert of FIG. 11.
Figure 13:
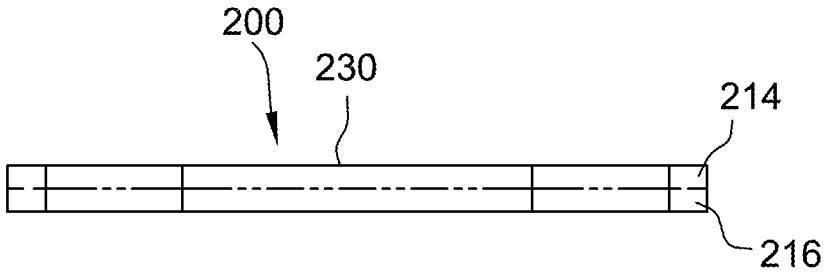
FIG. 13 is a back view of the shoe insert of FIG. 11.
Figure 14:
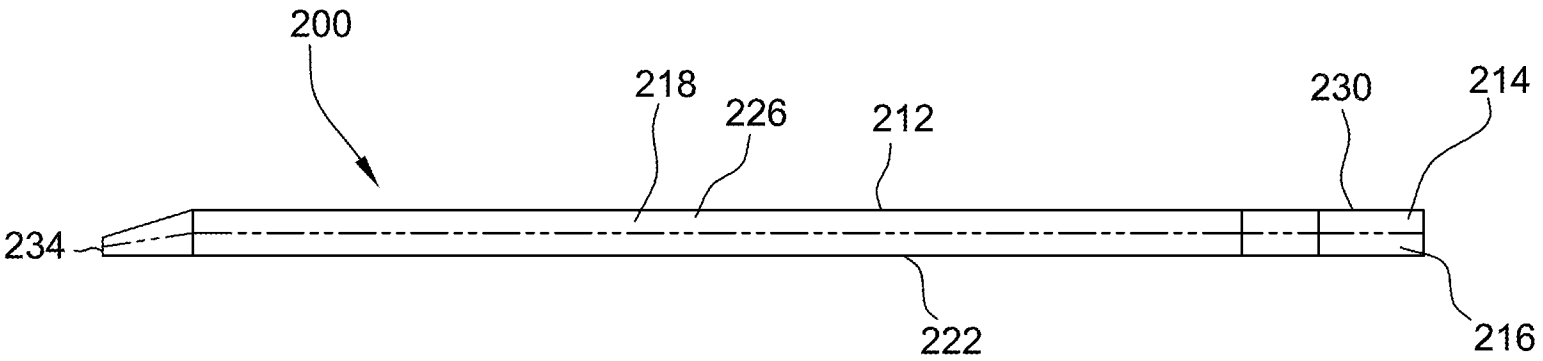
FIG. 14 is a side view of the shoe insert of FIG. 11.
Figure 15:
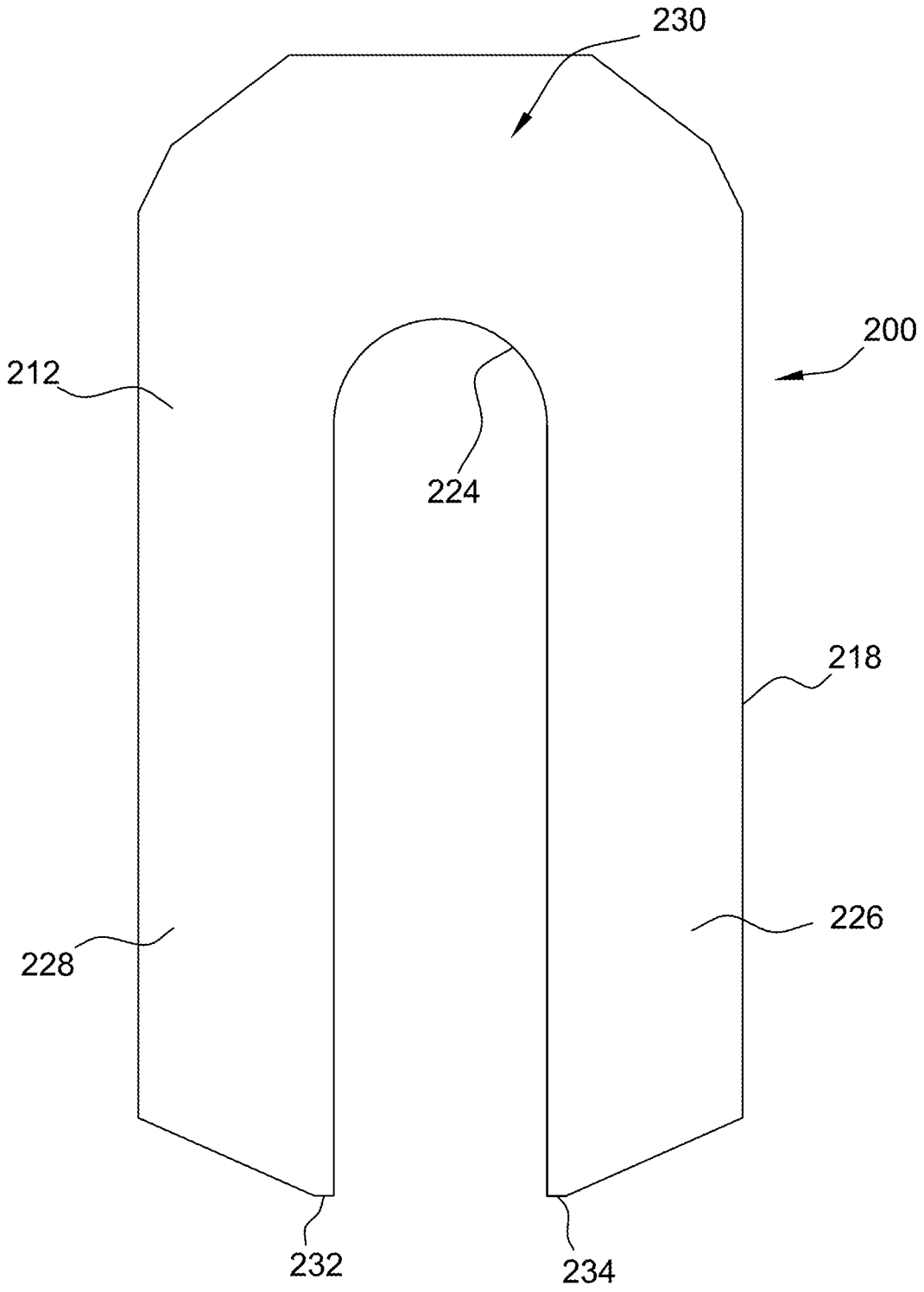
FIG. 15 is a top view of the shoe insert FIG. 11.
Figure 16:
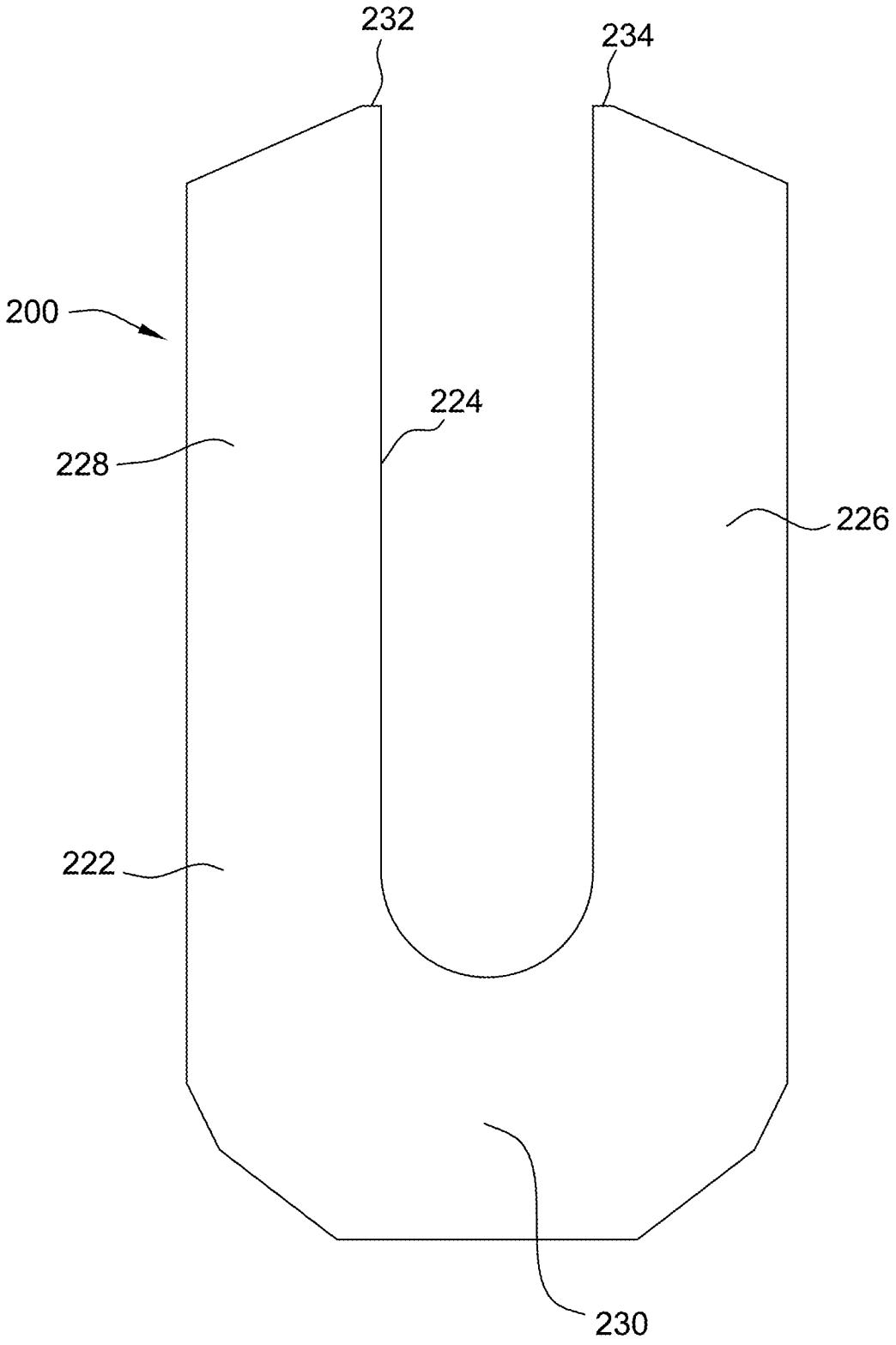
FIG. 16 is a bottom view of the shoe insert of FIG. 11.

The shoe insert 200 of the embodiment illustrated in FIGS. 11-16 comprises a generally U-shaped portion having an upper surface 212, a lower surface 222, an inner edge 224 that defines the inner extent of the U-shaped body, and an outer edge 218 that defines the outer perimeter (or part) of the U-shaped body. The outer edge 218 is configured for contiguous relationship with the article of footwear, and the outer edge is largely opposite the inner edge 224. As best seen in FIGS. 12 and 13, in the illustrated embodiment, the upper surface 212 is tapered downward from the outer edge 218 to the inner edge 224 at an angle of approximately 26°.

Figure 17:
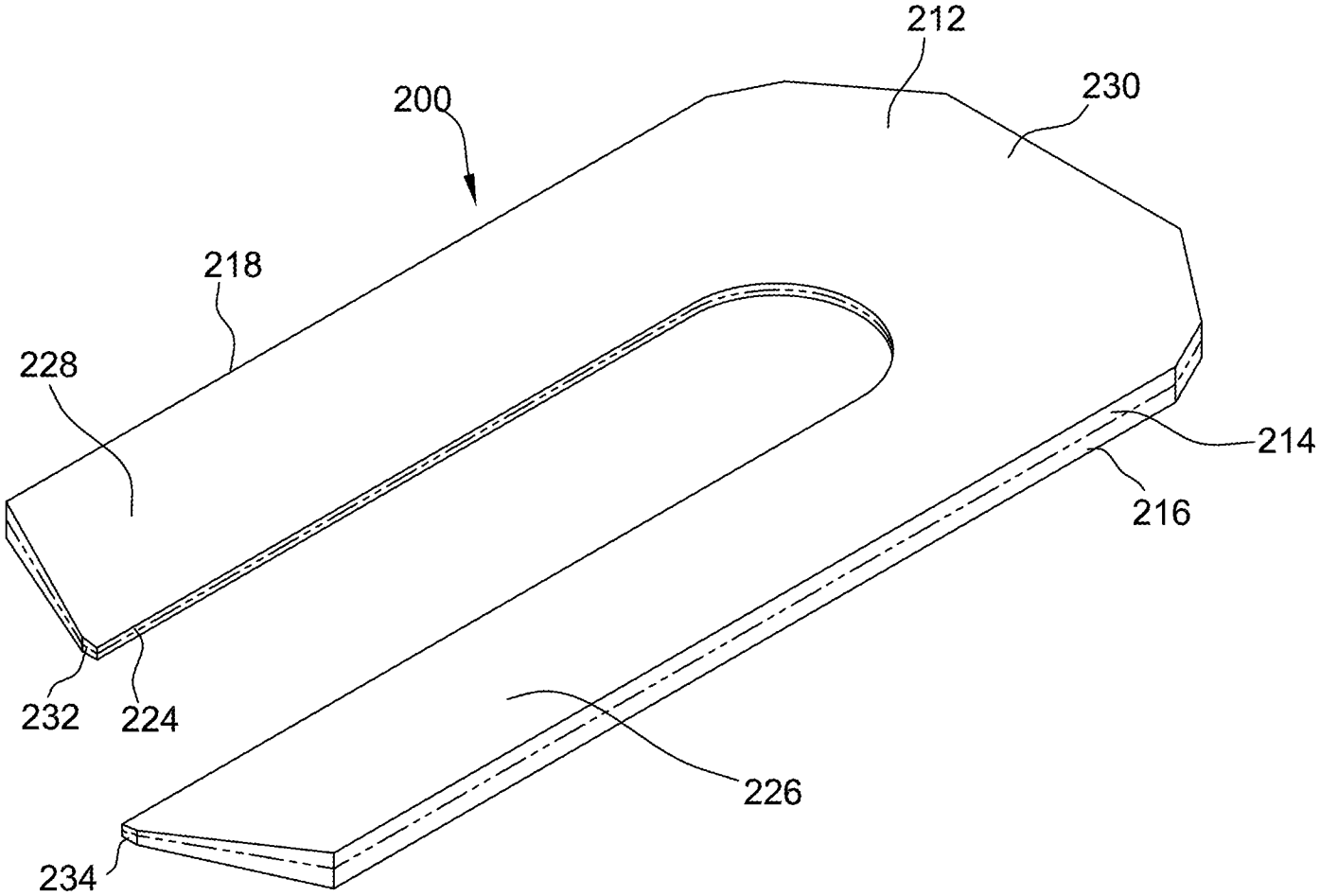
FIG. 17 is a perspective of yet another suitable embodiment of a shoe insert of the present disclosure, the shoe insert seen in FIG. 17 is similar to the insert depicted in FIG. 11 expect that one of the legs of the U-shaped portion has a different length than the other leg.

The shoe insert 200 further includes an arcuate portion, indicated generally by 230, a first leg, indicated generally by 226, and a second leg, indicated generally by 228. The first leg 226 and the second leg 228 extend from the arcuate portion 230 of the shoe insert 200 to their respective ends 234, 232. As illustrated in FIG. 11-16, the legs 226, 228 are of the same width and length. It is contemplated, however, that the legs 226, 228 can have any suitable width or length without departing from some aspects of this disclosure. In one suitable embodiment, the length of the legs 226, 228 is determined by the nature of the gait correction desired and is configured to allow the legs of the U-shaped portion to engage certain portions of the foot's anatomy (as explained in more detail below). In another embodiment, with reference to FIG. 17, the legs 226, 228 can have different lengths. For example, in the embodiment illustrated in FIG. 7, the leg 226 may be longer than the leg 228 in order to accommodate the length of the overlying anatomical feature of the foot that is desired to be supported. It is contemplated that the widths of the first and second legs 226, 228 can also be different.

In the illustrated embodiment, the ends 232, 234 are tapered back from the inner edge 224 to the outer edge 218 at approximately 45°. In other suitable embodiments that do not depart from some aspects of this disclosure, the ends 232, 234 may be square relative to the longitudinal axis of the respective leg 226, 228. In yet other suitable embodiments, the ends 212, 234 can be tapered back from the inner edge 224 to the outer edge 218 at an angle between 30° and 80°. In further suitable embodiments, the ends 232, 234 can be tapered from the inner edge 224 to the outer edge 218 at angles that are not equal. That is, one of the ends 232, 234 can be tapered at an angle different than the other end. It is contemplated that in some suitable embodiments, only one of the two ends 232, 234 is tapered. In such an embodiment, either end 232, 234 may be tapered while the other end is square relative to the longitudinal axis of the respective leg 226, 228. Thus, one of the ends 232, 234 may be square relative to the longitudinal axis of the respective leg 226, 228, and the other end may be tapered from the inner edge 224 to the outer edge 218 at an angle between 30° and 80°.

With reference to FIG. 11, in the illustrated embodiment, the arcuate portion 230 of the upper surface 212 of the U-shaped portion forms a support location configured to receive a heel of the foot of the user. FIG. 12, which is a front view of the shoe insert 200, illustrates the tapered portion of the upper surface 212 that tapers from the outer edge 218 to the inner edge 224 at an angle of approximately 45°. The tapered upper surface 212 of the U-shaped portion is configured to receive the foot of the user and to center the heel within the arcuate portion 230 of the shoe insert 200. The tapered upper surface 212 of the legs 226, 228 additionally acts to center the portions of the foot that overly the legs 226, 228 within the shoe insert 200. In the illustrated embodiment, the first leg 226, the second leg 228, and the arcuate portion 230 have the same 45° tapered upper surface 212, the taper extending generally from the outer edge 218 to the inner edge 224. In other suitable embodiments, the upper surface 212 can be tapered at any suitable angle ranging from 25° to 80°. In the illustrated embodiment, the upper surface 212 has a uniform, continuous taper that is the same throughout the arcuate portion 230 and each of the legs 226, 228. It is contemplated, however, that the arcuate portion 230 can have a taper that differs from the taper of the legs 226, 228. Such a configuration enables the arcuate portion 230 to promote centering the heel of the foot, and also enables the first leg 226 and the second leg 228 to exert less medially oriented force on the first and fifth metatarsal regions of the foot. In other suitable embodiments, the upper surface 212 of the arcuate portion 230, the first leg 226, and the second leg 228 can each have different angles. It is contemplated that the upper surface 212 of the U-shaped portion can have any suitable uniform or varying taper.

In the illustrated embodiment, the insert 200 includes an upper material 214 and a lower material 216 overlying the upper material. In the illustrated embodiment, the upper and lower materials 214, 216 are of the same thickness. The combined thickness of the upper material 214 and the lower material 216 is suitable to engage the foot and sufficiently support the foot to yield the desired gait correction(s). It is contemplated that the upper material 214 and the lower material 216 may be of differing thicknesses. For example, the lower material 216 may be of twice the thickness of the upper material 214, or any other suitable combination sufficient to yield the desired gait corrections. Additionally, there may be more than two layers that make up the shoe insert 200, each of varying or equal thicknesses. It is further contemplated that the insert 200 can be made from a single material.

Any suitable material or combination of suitable materials can be used to make the insert 200. In the illustrated embodiment, for example, the upper material 214 and the lower material 216 are fabricated from a suitable polymeric foam material that is of a sufficient density to yield the desired gait correction. In other suitable embodiments, the lower material 216 and the upper material 214 can be fabricated from polymeric foam materials having different densities. In still other suitable embodiments, the upper material 214 and the lower material 216 can be fabricated from materials that are of differing types.

In the illustrated embodiment, the shoe insert 200 has a lower surface 222 that is relatively flat and smooth, and thus configured for placement in face-to-face relationship with the insole of footwear. The outer edge 218 of the U-shaped portion is configured for contiguous relationship with the article of footwear into which the shoe insert 200 is placed. The contiguous relationship of the outer edge 218 of the shoe insert 200 with the article of footwear prevents the shoe insert 200 from moving in relation to the article of footwear. In one suitable embodiment, the lower surface 222 comprises an adhesive material for adhering the shoe insert 200 to the article of footwear to prevent motion of the shoe insert in relation to the article of footwear. It is contemplated that the lower surface 222 may also be fabricated from a high-friction material such that movement of the shoe insert 200 within the article of footwear is inhibited. In yet another suitable embodiment, the shoe insert 200 is fabricated as part of the article of footwear. For example, the shoe insert 200 can be formed as a single-piece with a shoe insole.

In use, the foot of the user rests on the upper surface 212 of the U-shaped portion with the outer part of heel of the foot positioned on the arcuate portion 230 of the shoe insert 200 and the inner part of the heel positioned within the opening defined by the arcuate portion and legs 226, 230. For the right foot, the leg 226 is configured to extent to a position adjacent and just short of the head of the first metatarsal and the leg 228 is configured to extend to a position adjacent and just short of the head of the fifth metatarsal. For the left foot, the leg 228 is configured to extent to a position adjacent and just short of the head of the first metatarsal and the leg 226 is configured to extent to a position adjacent and just short of the head of the fifth metatarsal. The ends 232, 234 of each of the legs 226, 228 are angled back from the inner edge 224 to the outer edge 218 at a 26° angle. The length of the legs 226, 228, and thus the resulting location of the ends 232, 234, and the angles of the ends facilitate smooth weight transfer in the foot during gait. Initially, the heel is loaded and the tapered upper surface 212 of the arcuate portion 230 engages and forces the heel into the center of the shoe insert 200, forming the first point of contact with the support surface. As weight shifts from the heel through the fifth metatarsal, the leg 228 (a right foot is being described for this example) supports the foot while allowing the fifth metatarsal head to drop below the level of the second, third, and fourth metatarsals. The angled end 232 is configured to engage the fifth metatarsal just behind its head so that smooth weight transfer is promoted and so that the fifth metatarsal head is able to drop below the other metatarsals and form the second point of contact with the support surface. Once the second point of contact is established by the head of the fifth metatarsal, weight begins to shift across the foot to the first metatarsal, which is engaged by the leg 226. The end 234 is angled to promote smooth weight transfer to the first metatarsal head and to allow the first metatarsal head to drop below the plane of the second, third, and fourth metatarsals. In another embodiment, the lengths of the leg 226 and the leg 228 are different. For example, the leg 226 may be shorter than the leg 228 to account for a variation in the lengths of the first and fifth metatarsals. The difference in length enables the process of smooth weight transfer to occur while utilizing the shoe insert 200 with a foot of particular anatomical structure.

The apparatus, system, and methods described in detail herein enable a shoe insert assembly to create three point triangular contact for the foot when utilized in an article of footwear. The first and fifth metatarsal heads are allowed to drop below the plane of the second, third, and fourth metatarsals, forming two of the three points of contact. The heel portion of the shoe insert is designed to accept the heel and to stabilize it in the center of the shoe insert, creating the third contact point. Using the shoe insert, the three points of contact may be maintained on soft or hard surfaces, and with flat-soled articles of footwear. In addition, the legs of the shoe insert are configured to enable smooth weight transfer during gait.

Figure 18:
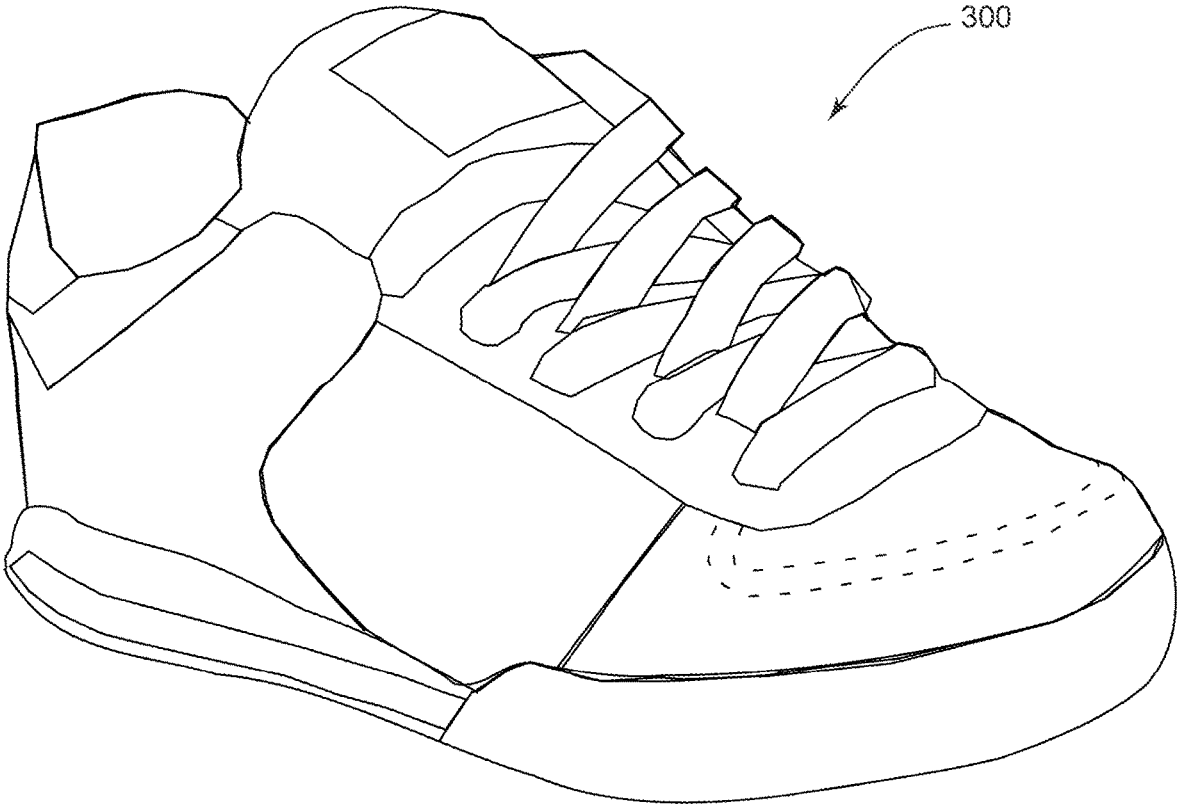
FIG. 18 is a perspective view of example footwear suitable for receiving the foot engagement device of the present disclosure.

FIG. 18 is a perspective view of example footwear, indicated generally at 300, suitable for receiving the foot engagement devices of the present disclosure. It should be noted that when used herein, the term "footwear" means any suitable article intended to be worn on the feet such as, but is not limited to, boots, shoes, athletic shoes (as seen in FIG. 18), court shoes, pumps, diabetic shoes, espadrilles, galoshes, lace-up shoes, derby shoes, oxford shoes, brogues, high-tops, loafers, Mary Janes, moccasins, monks, mules, platform shoes, school shoes, skate shoes, sneakers, tap shoes, toe shoes, sandals, Kolhapuri Chappals, Peshawari chappals, flip-flops, thongs, slides, Worishofers, Avarcas, slippers, Ballet shoes, high-heeled shoes, climbing shoes, clogs, football boots, sabatons, safety footwear, ski boots, snowshoes, surgical shoes, pointe shoes, swimfins, flippers and socks. Thus, unless otherwise specifically limited, the term "footwear" is used herein to include all possible articles or garments intended to be worn on the feet.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the embodiments, including the best mode, and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

As various changes could be made in the above embodiments without departing from the scope of the disclosure, it is intended that all matter contained in the above description and shown in the accompanying drawings shall be interpreted as illustrative and not in a limiting sense.

What is claimed is:

1. A method of using a foot device, the foot device configured to receive a foot of a user, the foot device including a generally U-shaped portion having an arcuate portion, a first leg and a second leg, the first leg and the second leg extending from the arcuate portion, each leg having an end and a relief area disposed adjacent the respective end, each relief area angled back from an inner edge of the U-shaped portion toward an outer wall of the U-shaped portion such that the part of the relief area furthest from the arcuate portion is at the inner edge and the part of the relief area closest to the arcuate portion is at the outer wall, the method comprising:

engaging the arcuate portion with a heel of the foot to form a first point of contact;

engaging the first leg of the arcuate portion with a lateral portion of the foot such that the weight of the foot is transferred from the first point of contact along the first leg of the arcuate portion;

disposing the relief area of the first leg proximate a fifth metatarsal head of the foot such that the fifth metatarsal head drops to form a second point of contact;

engaging a base portion of the foot device with fourth, third, and second metatarsals such that the weight of the foot is transferred medially from the second point of contact along the base portion of the foot device; and disposing the relief area of the second leg proximate a first metatarsal head of the foot such that the first metatarsal head drops to form a third point of contact.

2. The method of claim 1, wherein the fifth and first metatarsal heads form the second and third points of contact by dropping below the second, third, and fourth metatarsal heads.

3. The method of claim 1, the U-shaped portion being disposed in an overlying face-to-face relationship with the base portion, wherein a sole of the user's foot overlies and is in contact with both the base portion and the U-shaped portion.

4. The method of claim 1, wherein the second leg is longer than the first leg to accommodate for the anatomical longitudinal offset between the first metatarsal head and the fifth metatarsal head of the user's foot.

5. The method of claim 1, the foot device further comprising:

a heel portion adapted to receive the heel of the user's foot including a calcaneus of the foot;

a middle portion adapted to receive a central part of the user's foot including metatarsals of the foot; and a front portion adapted to receive the forward part of the user's foot including phalanges of the foot.

6. The method of claim 1, wherein a width of each relief area increases between the inner edge of the U-shaped portion and the outer edge of the U-shaped portion to form a sloped triangular surface.

7. The method of claim 1, wherein engaging a front portion of the foot device with fourth, third, and second metatarsals further comprises shifting the weight of the foot medially along a metatarsal axis M from the second point of contact toward the third point of contact.

8. A method of using a foot device, the foot device configured to receive a foot of a user, the foot device including a generally U-shaped portion having an arcuate portion, a first leg, and a second leg, the first leg and the second leg extending from the arcuate portion, each leg having an end and a relief area disposed adjacent the respective end, each relief area angled back from an inner edge of the U-shaped portion toward an outer wall of the U-shaped portion such that the part of the relief area furthest from the arcuate portion is at the inner edge and the part of the relief area closest to the arcuate portion is at the outer wall, the method comprising:

engaging the arcuate portion with a heel of the foot to form a first point of contact;

positioning the relief area of the first leg proximate a fifth metatarsal head of the foot such that the fifth metatarsal head drops to form a second point of contact; and positioning the relief area of the second leg proximate a first metatarsal head of the foot such that the first metatarsal head drops to form a third point of contact, wherein the first, second, and third points of contact form a triangle-shaped contact surface.

9. The method of claim 8, wherein the fifth and first metatarsal heads form the second and third points of contact by dropping below second, third, and fourth metatarsal heads.

10. The method of claim 8, further comprising a base portion, the U-shaped portion being disposed in an overlying face-to-face relationship with the base portion, wherein a sole of the user's foot overlies and is in contact with both the base portion and the U-shaped portion.

11. The method of claim 8, wherein the second leg is longer than the first leg to accommodate anatomical longitudinal offset between the first metatarsal head and the fifth metatarsal head of the user's foot.

12. The method of claim 8, the foot device further comprising:

a heel portion adapted to receive the heel of the user's foot including a calcaneus of the foot;

a middle portion adapted to receive a central part of the user's foot including metatarsals of the foot; and a front portion adapted to receive the forward part of the user's foot including phalanges of the foot.

13. The method of claim 8, wherein a width of each relief area increases between the inner edge of the U-shaped portion and the outer edge of the U-shaped portion to form a sloped triangular surface.

* * * * *